US006425313B1

(12) United States Patent
Kleinedler et al.

(10) Patent No.: US 6,425,313 B1
(45) Date of Patent: Jul. 30, 2002

(54) AXIAL PISTON MOTOR

(75) Inventors: Peter Kleinedler, Dubnica nad Vahom; Emilia Kapitanciková, Martin; Lubomir Kanis, Turcianske Teplice, all of (SK)

(73) Assignee: Apis Energy GmbH, Düsseldorf (DE)

( * ) Notice: Subject to any disclaimer, the term of this patent is extended or adjusted under 35 U.S.C. 154(b) by 0 days.

(21) Appl. No.: 09/527,934

(22) Filed: Mar. 16, 2000

Related U.S. Application Data

(63) Continuation of application No. PCT/IB99/00319, filed on Feb. 22, 1999.

(51) Int. Cl.[7] ..... F01B 13/04
(52) U.S. Cl. ..... 92/12.2; 92/131
(58) Field of Search ..... 92/12.2, 130 A, 92/131; 91/506; 74/839

(56) References Cited

U.S. PATENT DOCUMENTS

| | | | | |
|---|---|---|---|---|
| 3,063,381 A | * | 11/1962 | Budzich | 92/12.2 |
| 3,631,763 A | * | 1/1972 | Court | 92/12.2 |
| 3,667,867 A | | 6/1972 | Boydell et al. | |
| 3,733,970 A | | 5/1973 | Bosch | |
| 4,843,950 A | * | 7/1989 | Heyl | 92/12.2 |
| 4,896,585 A | * | 1/1990 | Foster | 92/71 |
| 5,226,349 A | * | 7/1993 | Alme et al. | 92/12.2 |

FOREIGN PATENT DOCUMENTS

| | | |
|---|---|---|
| DE | 26 55 122 A1 | 6/1978 |
| DE | 31 35 605 A1 | 3/1983 |
| DE | 33 46 000 C2 | 6/1984 |
| DE | 37 11 041 C2 | 10/1988 |
| DE | 41 04 561 A1 | 8/1991 |
| DE | 44 45 255 A1 | 6/1996 |
| GB | 2 097 068 A | 10/1982 |

* cited by examiner

*Primary Examiner*—Edward K. Look
*Assistant Examiner*—Igor Kershteyn
(74) *Attorney, Agent, or Firm*—Goodwin Procter LLP

(57) ABSTRACT

In an axial piston motor having a drive shaft, an inclined plate, and an adjusting device for the inclined plate, and at least one adjusting control cylinder with control piston adapted to establish pressure contact and to cooperate with the inclined plate and having a closed face and being formed as an inwardly open cylinder having an open end, a coil spring disposed within the inwardly open cylinder and pressing against the closed face, a sliding bush having two ends, one end thereof ranging into the inwardly open cylinder and having a flange at its opposite end and having different operating positions, one end of the coil spring resting against the flange, with the coil spring biasing the flange away, the improvement which comprises a rod connected to the closed face of the control piston, the sliding bush being formed as a hollow cylindrical sliding object having an inside diameter guided upon the rod.

8 Claims, 3 Drawing Sheets

AXIAL PISTON MOTOR

This is a continuation of international application No. PCT/IB99/00319, filed on Feb. 22, 1999.

FIELD OF THE INVENTION

The invention relates to an axial piston motor.

BACKGROUND

On traditional axial piston motors of the type involved, such as are described e.g. in German patent No. 3,714,888, a control cylinder with control piston assembly is provided to which actuating pressure can be applied and having a displaceable part which is connected with the actuator of the axial piston motor. The control cylinder with control piston assembly is of a circular design and is disposed about a cylindrical drum. The control cylinder here has an annular space containing a bush which is spring-loaded on one side and can have pressure medium applied to its other side, and which cooperates with a cradle having a skew plate. If pressure medium is applied to the annular space, the bush moves against the force of the spring and displaces the cradle, together with the skew plate, from its effective position to its ineffective operating position. This happens independently of the instantaneous power of the drive unit. It is a consequence of this that the axial piston motor does not work unconditionally, and not always in its optimum operating range and thus does not achieve optimum efficiency.

Axial piston motors are also known from German patents Nos. 3,135,605; 3,346, 000 and German published application No. 1,947,641. The main problem improved by the present invention is not recognized in the aforementioned prior art and no measures are there proposed by means of which this problem could be solved.

For example, the adjusting device of German patent No. 3,135,605 has at least one control cylinder with a control piston, to which actuating pressure can be applied and which cooperates with the skew plate. The control piston cooperates with at least one spring body acting in the axial direction of the control cylinder. The control piston is configured as an open hollow cylinder, and its closed end face is connected under pressure with the spring body. The control piston has an auxiliary piston provided with a spring plate while arranged between the end face and the plate of the spring body which presses the spring plate away from the end face.

The spring plate is disposed here in its one operating position outside the control piston and coincides in its other operating position with the open end face of the control piston. It is also known from German published patent application ser. No. 1,947,641, that in the effective position of the skew plate at least one spring body is compressed, and the spring body is configured as a helical spring.

Finally, from German patent No. 3,346,000 it is known to provide at least two control cylinders which are disposed symmetrically with respect to the axis of rotation of the drive device.

It is an object of the present invention to eliminate the above drawback.

BRIEF DESCRIPTION OF THE INVENTION

In an axial piston motor having a drive shaft, an inclined plate, and an adjusting device for the inclined plate, and at least one adjusting control cylinder with control piston adapted to establish pressure contact and to cooperate with the inclined plate and having a closed face and being formed as an inwardly open cylinder having an open end, a coil spring disposed within the inwardly open cylinder and pressing against the closed face, a sliding bush having two ends, one end thereof ranging into the inwardly open cylinder and having a flange at its opposite end, one end of the coil spring resting against the flange, with the coil spring biasing the flange away, the improvement which comprises a rod connected to the closed face of the control piston, and the sliding bush being formed as a hollow cylindrical sliding object having an inside diameter guided upon the rod.

The invention is realized by an axial piston motor, the efficiency of which is optimised by a control device, by the inclination of the skew plate being adjusted to the instantaneous power of the drive device. This adjustment is suitably automatically carried out.

A particularly expedient embodiment of the present invention provides for the adjusting device to have at least one control cylinder with control piston to which actuating pressure can be applied and which cooperates with the skew plate, and which preferably co-operates with at least one spring body acting in the axial direction of the control cylinder. In this inventive idea it is expedient if at least one spring body is compressed in the effective position of the skew plate. Moreover, a suitable embodiment of the invention provides for the control piston to be configured as a hollow cylinder which is inwardly open and the closed end face of which is connected under pressure with the spring body. The control piston can here be an inward directed coaxial rod, with a hollow cylindrical slide bush which can be displaced on the rod and with a flange disposed on its free end and the spring body between the end face and the flange. The spring body presses the flange away from the end face. This way a control cylinder with control piston assembly is obtained with maximum stroke movements and with minimum dimensions.

In a further suitable embodiment of the invention the slide bush is configured open on both sides and carries the spring body. Provision can here be made for the free end of the rod, which has a circular cross section, to bear a collar which is larger in diameter, for the other free end of the slide bush to terminate in a ring with a reduced inner diameter, and for the spring body to be disposed between the flange and the end face. The diameter of the rod roughly corresponds to the inner diameter of the ring.

A further suitable embodiment of the present invention provides for a collar with a circular cross section with an external diameter which roughly corresponds to the internal diameter of the slide bush. The free end face of the collar lies in the plane of the open end of the hollow cylinder. This achieves that in the driven-in piston, the spring bodies are disposed inside the control piston, while in the maximum driven-out position of the control piston, the spring bodies are disposed spaced from the end face of the control cylinder. The flange is disposed in its one operating position outside the control piston, and in its other operating position it reaches the proximity of the open end face of the control cylinder.

A particularly suitable embodiment of the present invention provides for at least two, suitably three, four, five or more control cylinders to disposed roughly symmetrically about the axis of rotation of the drive.

In the present invention it is particularly expedient if the spring body comprises one or more helical compression springs which have differing characteristic curves.

BRIEF DESCRIPTION OF THE DRAWING

An embodiment of the invention is represented schematically in the drawing and is explained in greater detail below. In the drawing.

DETAILED DESCRIPTION

Figure 1:
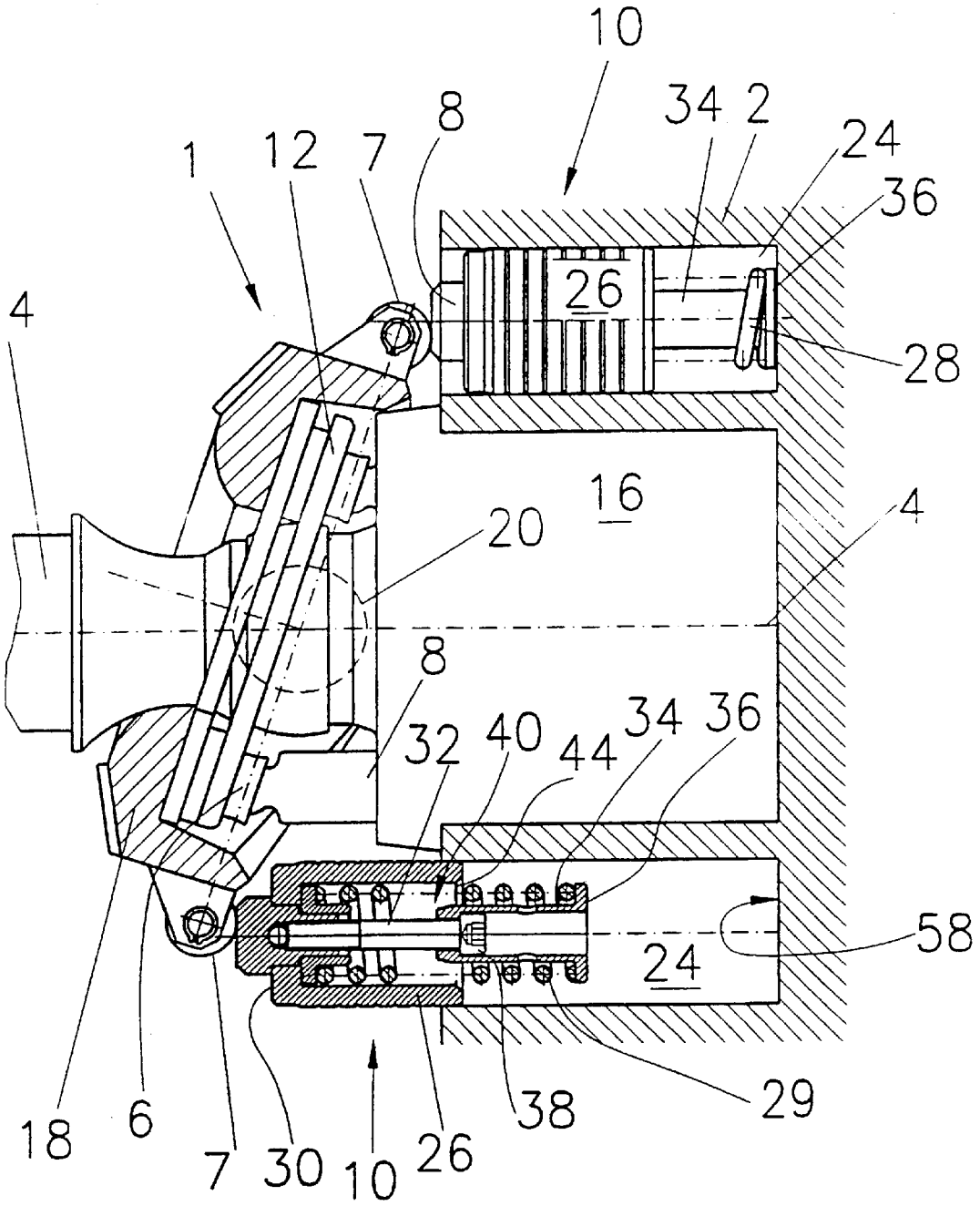
FIG. 1 is a part cross-sectional view of an axial piston motor on the invention.

A part of an axial piston motor is shown in FIG. 1, the pistons 8 of which have balls at their respective ends. A slide shoe 6 is pressed against the ball ends. The shoe slides on an inclined plate/skew plate 12 at an adjustable pivoting angle. The high surface pressure and the high sliding speed require particularly well designed lubrication on the slide shoes 6. For this purpose, lubricating pressure oil is taken through nozzles and hollow bore pistons from a pressurised chamber. The slide shoe 6 is so designed that the lubricating pressure also reduces the force with which the piston 8 is pressed onto the inclined plate 12. Each piston 8 describes an intake stroke and a pressure stroke through the inclined position of the piston path. The cylindrical drum 16 with the pistons 8 is set in rotation through the drive shaft 14 to which it is securely connected. The slide shoes 6 are also held in the intake stroke on the inclined plate 12, through a hold-down plate, so that they are self-priming.

The axial piston motor is provided with a drive shaft device 14 and an adjusting device 10, which in the present case comprises four control cylinders with control piston assemblies, for the skew plate 12. A control device is provided to match the characteristic curve of the drive shaft 14 to the characteristic curve of the 10 adjusting device 10. That control device comprises the four adjusting devices with adjustable operating pressure. An optimal match is produced by the control device, between the performance curve (characteristic curve) of the drive shaft and the performance curve (characteristic curve) of the control device. The adjusting device 10 has four adjusting cylinders 24 with control pistons 26 to which actuating pressure can be applied and which cooperate with the skew plate 12. The control cylinders 24 cooperate with one or more springs 28, 29 active in the axial direction of the control cylinders 24, at least one spring body 28 being compressed in the effective position of the skew plate 12. The control piston 26 is configured as a hollow cylinder, open towards the inside and the closed end face of which is connected under pressure with the spring 28, 29. The end, configured as a ram 9 (FIG. 3) of the control piston 26 is supported on a cradle 18 which has rollers 7 to minimize the friction that occurs. The respective control piston 26 bears a coaxial and inwardly directed rod 32 with with a hollow cylindrical slide bush 34, which can be displaced on the rod 32 and a flange 36 disposed on its free end. Between the end face and the flange 36 is the spring 28 or 29, which presses the flange 36 away from the end face 30. The slide bush 34 is configured open on both sides. The free end of the rod 32 which has a circular cross section, bears a collar 38 which is larger in diameter. The other free end 40 of the slide bush 34 terminates in a ring 42 with a reduced inner diameter. The spring is disposed between the flange 36 and the end face 30. The spring 28 or 29 is disposed. It can be seen that the diameter of the rod 32 corresponds approximately to the inner diameter of the ring 42. It can furthermore be seen that the collar 38 has a circular cross-section and has an outer diameter which roughly corresponds to the inner diameter of the slide bush 34. The free end face of the collar 38 lies in the proximity of the open end of the control piston 26. The flange 36 is disposed in its one operating position (FIG. 3) outside the piston 26, while in its other operating position it reaches the proximity of the open end face 44 of the control piston 26.

Figure 3:
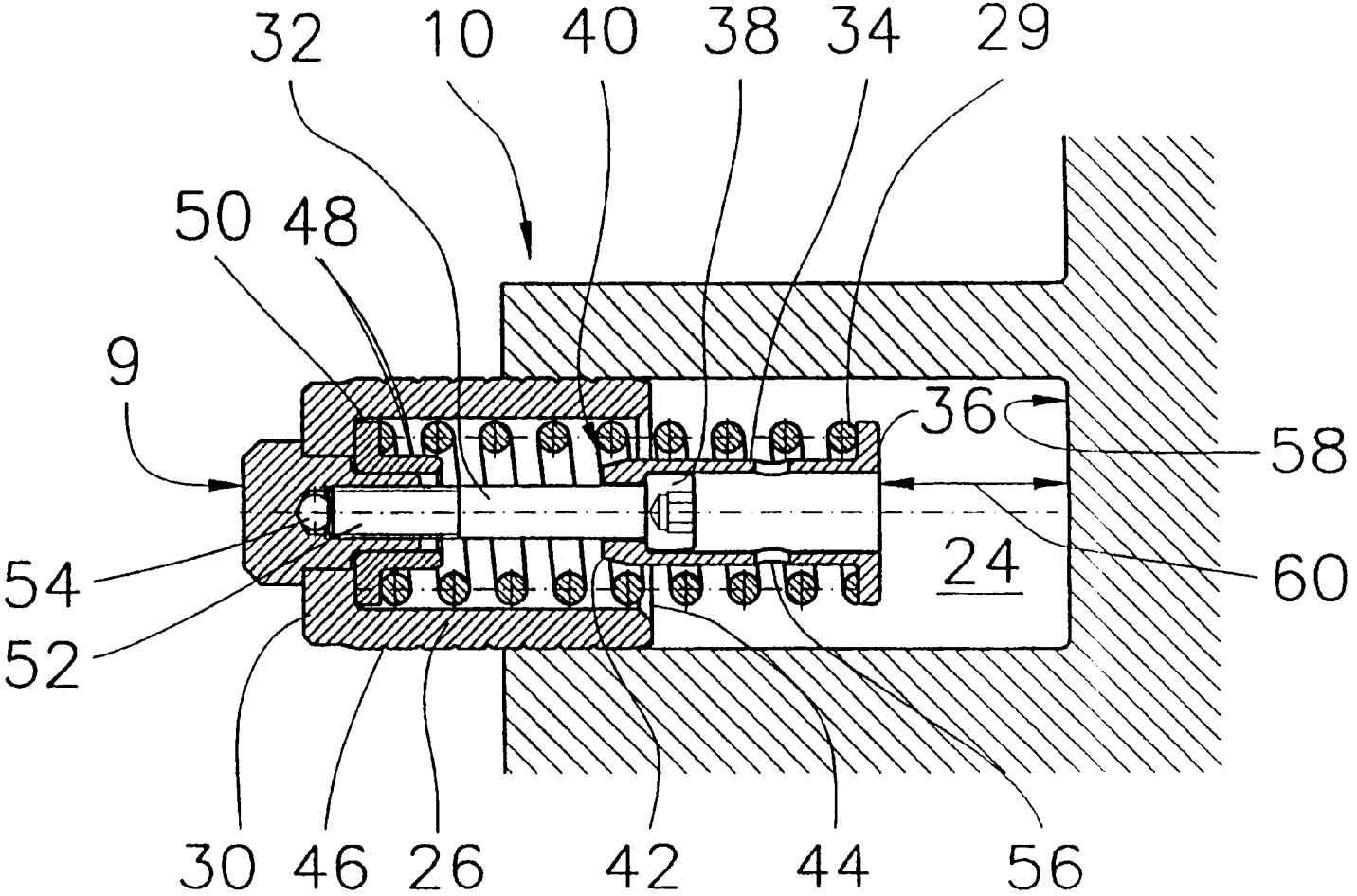
FIG. 3 is an enlarged view of the part designated as III in FIG. 1, shown in enlargement.

FIG. 3 shows further details of the control cylinder with control piston assembly. The control piston 26 is provided on its longitudinal outer side with a number of annular grooves, such as annular groove 46. These annular grooves assist in lubricating the control piston 26 in the control cylinder 24 more effectively.

The ram 9 is held in an aperture on the end face of the control piston 26 by a locking ring 48 which is pushed as a force fit or screwed onto the tapered inner end of the ram 9. The locking ring 48 is provided with a flange 50 to support the helical compression spring 29.

The rod 32 is screwed to a threaded end part 52 in a threaded bore of the ram 9, a ball inserted between the end of the threaded end part 52 and the ram 9 serving to ensure the screw connection of the rod 32 to the ram 9.

Apertures 56 are provided approximately centrally in the longitudinal wall of the slide bush 34. If the helical compression spring 29 is compressed during operation, a vacuum is created between the collar 38 and the ring 42. The apertures co 56 compensate for this vacuum and ensure that the compensating function of the compensating device, formed from the rod 32, slide bush 34, end spring 29, is not substantially impaired. Moreover, the compensating function acts in such a way that the operating pressure which occurs in an intentional adjustment of the control piston 26 of the pressure medium, the supply of which to the control cylinder 24 is not shown in FIG. 3, at first only acts on the slide bush 34, since the inclined plate 12 with the pistons 8 working thereon offers resistance to the displacement of the control piston 26, which is only gradually overcome. This compensating function also comes into operation with changes in the load of the pistons 8.

As shown in FIGS. 1 and 3, the flange 36 runs through an adjusting path 60 until this flange abuts against the base 58 of the control cylinder 24.

Figure 2:
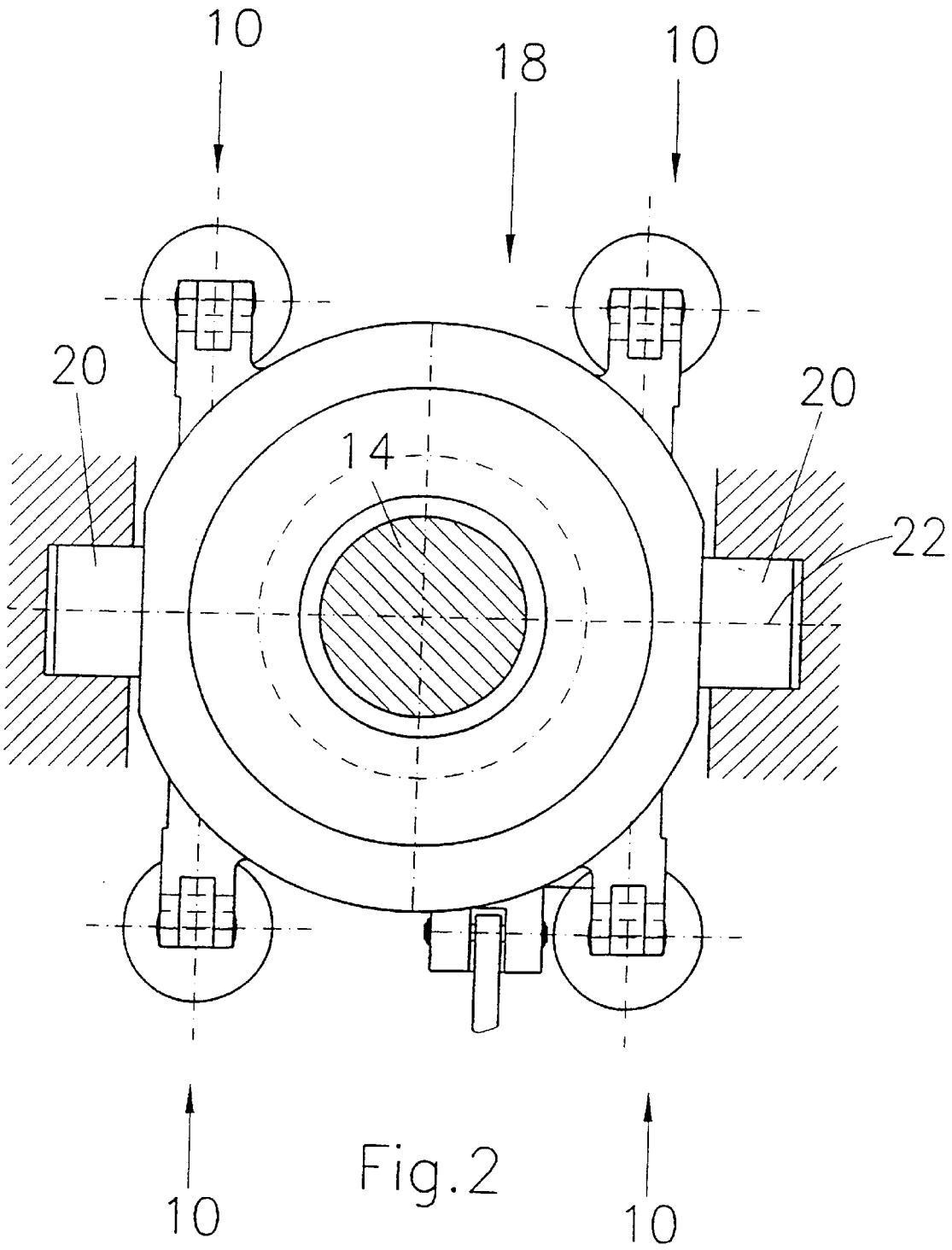
FIG. 2 is an axial plan view of a cradle.

FIGS. 1 and 2 show that four control cylinder adjusting devices 10 are provided disposed approximately symmetrically about the axis of rotation 4 of the drive shaft 14. The springs 28, 29 are helical compression springs, and two or more of these springs can be provided with differing characteristic curves. The cradle 18 has two coaxially dispersed journals 20, disposed as hinged bodies in the housing of the axial piston motor 1, so that the cradle 18 is adjustable and can be pivoted around an axis 22 (FIG. 2).

What is claimed is:

1. In an axial piston motor having a drive shaft, an inclined plate, and an adjusting device for said inclined plate, and at least one adjusting control cylinder with a control piston adapted to establish pressure contact and to cooperate with said inclined plate and having a closed face and being formed as an inwardly open cylinder having an open end, a coil spring disposed within said inwardly open cylinder and pressing against said closed face, a sliding bush having two ends, one end thereof ranging into said inwardly open cylinder and having a flange at its opposite end and having different operating positions, one end of said coil spring resting against said flange, with said coil spring biasing said flange away, the improvement which comprises an axial rod connected by threads to said closed face of said control piston, and said sliding bush being formed as a hollow cylindrical sliding object having an inside diameter guided upon said rod.

2. The axial piston motor of claim 1, wherein both ends of said sliding bush are open.

3. The axial piston motor of claim 1, wherein said rod has a circular cross section having a diameter, the axial rod further comprises a collar having a free front end, said collar having a diameter that is greater than said diameter of said rod, and a ring of reduced inside diameter disposed at the end of said sliding bush that ranges into said inwardly open cylinder.

4. The axial piston motor of claim 3, wherein the diameter of said rod approximately corresponds to the inside diameter of said ring.

5. The axial piston motor of claim 3, wherein the outer diameter of said collar corresponds to the inside diameter of said sliding bush, and said free front end of said collar is disposed adjoining the open end of said control piston.

6. The axial piston motor of claim 1, wherein said flange in one of its operating positions is disposed outside of said control piston, and in another of its operating positions is disposed adjacent to the open end of said control piston.

7. The axial piston motor of claim 1, wherein the motor comprises at least two adjusting devices that are disposed substantially symmetrically about said drive shaft.

8. The axial piston motor of claim 1, comprising a plurality of springs, each having differing bias characteristics.

* * * * *